US006766760B2

(12) United States Patent
Garcia

(10) Patent No.: US 6,766,760 B2
(45) Date of Patent: Jul. 27, 2004

(54) FLEXIBLE MARKER DEVICE

(75) Inventor: Guadalupe C. Garcia, Modesto, CA (US)

(73) Assignee: Worldwide Safety, LLC, Sacramento, CA (US)

( * ) Notice: Subject to any disclaimer, the term of this patent is extended or adjusted under 35 U.S.C. 154(b) by 0 days.

(21) Appl. No.: 10/131,316

(22) Filed: Apr. 23, 2002

(65) Prior Publication Data

US 2003/0136329 A1 Jul. 24, 2003

Related U.S. Application Data

(60) Provisional application No. 60/360,141, filed on Feb. 22, 2002, and provisional application No. 60/351,557, filed on Jan. 23, 2002.

(51) Int. Cl.[7] ..... E01F 9/00
(52) U.S. Cl. ..... 116/63 C; 116/63 P
(58) Field of Search ..... 116/63 P, 63 R, 116/63 C; 40/612; 404/6, 9, 10

(56) References Cited

U.S. PATENT DOCUMENTS

| | | | | | |
|---|---|---|---|---|---|
| 2,333,273 | A | | 11/1943 | Scanlon et al. | 40/125 |
| 2,762,328 | A | * | 9/1956 | Weig | 116/63 C |
| 2,817,308 | A | * | 12/1957 | Scanlon | 116/63 C |
| 3,386,409 | A | | 6/1968 | Dawson | 116/63 |
| 3,499,413 | A | * | 3/1970 | Heard | 116/63 P |
| 3,851,616 | A | * | 12/1974 | Brown | 116/63 R |
| 4,006,702 | A | * | 2/1977 | St. Cyr | 116/63 P |
| 4,197,807 | A | * | 4/1980 | Campbell | 116/63 P |
| 4,256,050 | A | * | 3/1981 | Barnard | 116/63 C |
| 4,571,118 | A | * | 2/1986 | Schmanski | 116/63 R |
| 4,979,461 | A | | 12/1990 | Provence, Jr. | |
| 5,375,554 | A | * | 12/1994 | Yen | 116/63 C |
| 5,421,668 | A | | 6/1995 | Cowan et al. | |
| 5,439,311 | A | * | 8/1995 | Hughes | 40/612 |
| 5,488,792 | A | * | 2/1996 | Kwok | 116/63 C |
| 5,888,016 | A | | 3/1999 | Ahn | 404/10 |
| 5,993,105 | A | | 11/1999 | Chan | 404/10 |
| 6,119,621 | A | * | 9/2000 | Johnson | 116/63 C |
| 6,247,424 | B1 | | 6/2001 | Huang | |
| 6,499,858 | B2 | * | 12/2002 | Hart | 116/63 C |

FOREIGN PATENT DOCUMENTS

| | | | | |
|---|---|---|---|---|
| DE | 3524084 | * | 1/1987 | 404/9 |
| DE | 3940007 A1 | * | 6/1991 | 116/63 C |
| FR | 2618245 A1 | * | 1/1989 | 40/612 |

OTHER PUBLICATIONS

United States of America Department of Energy, Newton BBS, 2 pages, Feb. 11, 2004.
Oxford Dictionary of Physics, fourth edition 2000, pp. 226–227.
Hyperdictionary, IMPULSE:Dictionary Entrydal Meaning, 2000–2003.

(List continued on next page.)

*Primary Examiner*—Diego Gutierrez
*Assistant Examiner*—Travis Reis
(74) *Attorney, Agent, or Firm*—Lumen Intellectual Property Services, Inc.

(57) ABSTRACT

A new marker device is provided for increased safety due to a flexible design. The marker device includes a base and a flexible means that is positioned over the base. The bottom part of the flexible means is attached to the base. The flexible means maintains in an original position in absence of a natural or traffic perturbation. However, flexible means deviates from this original position in presence of a natural or traffic perturbation. Moreover, the flexible means restores from this deviated position back to the original position after the perturbation disappears or is removed. Furthermore, the marker device includes a cover to cover the flexible means.

13 Claims, 7 Drawing Sheets

OTHER PUBLICATIONS

Letter from Betty Green, Logan County Road & Bridge Department, Oct. 29, 2003, 2 pages.
Letter from Arthur Anderson, Department of California Highway Patrol, Oct. 31, 2003, 1 page.
ATSSA, ATSSA 2003 Innovation Awards Presented in New Orleans, Press Release Jan. 14, 2003.
Patrick Giblin, Modbee.com (The Modesto Bee). "A better cone for the road", Posted on Sep. 19, 2003 04:25:10.

* cited by examiner

FLEXIBLE MARKER DEVICE

CROSS-REFERENCE TO RELATED APPLICATIONS

This application is cross-referenced to and claims priority from U.S. Provisional Application No. 60/351,557 filed on Jan. 23, 2002 and No. 60/360,141 filed on Feb. 22, 2002, which are hereby incorporated by reference.

FIELD OF THE INVENTION

The present invention relates generally to traffic marker devices or safety cones used to alert or divert vehicles, watercrafts, aircrafts and pedestrians to pass safely around hazards, obstacles or other areas. More particularly, the present invention relates to a flexible safety marker device which self-positions to its original position, deviates from its original position due to natural or traffic perturbations, and restores to its original position from a deviated position in case such perturbations disappear or are removed.

BACKGROUND

Traffic or safety cones, are routinely used to direct motorists and pedestrians away from obstacles or dangerous area. These cones are usually brightly colored, hollow conical shaped devices made of a synthetic, rubber or other plastic (See for example U.S. Pat. No. 2,333,273 to Scanlon et al.). Traffic and safety cones are meant to minimize damage to persons or vehicles which may collide with the cones. However, safety cones are still of significant danger to the public. One reason is that, although the traffic cones are made out of a synthetic, rubber or other plastic, they are still relatively rigid and tend to fall over easily when the cones are subject to natural or traffic wind, perturbations by passing traffic or violence. Furthermore, safety cones that are, for instance, run over or hit by a vehicle, could become dangerous objects or obstacles by being airborne or simply laying on the road, in particular to following traffic or surrounding people.

A variety of different self-righting traffic cones have been proposed. For instance, U.S. Pat. No. 3,386,409 to Dietz Company describes to shape the base of the cone in such a manner that the cone is nestable or stackable self-righting in the manner of a self-righting top. The objective of U.S. Pat. No. 3,386,409 is to provide a nestable cone which, when it has been toppled over, will not roll away but will right itself and stand erect near to the position in which it was originally placed. This was accomplished by a hollow molded plastic traffic cone that has a base portion weighted to give a low center of gravity to the cone. The annular bottom of the base is gradually curved outward and upward to provide rockers so the cone is self-righting and is divided into six angularly spaced triangular legs to prevent rolling when the cone is knocked over.

U.S. Pat. No. 5,888,016 to Eui Sig Ahn et al. describes a traffic collar cone that has a delineator having a reflection sheet attached on its upper part. A plug is placed under the sheet having an air inlet and outlet extending upwardly and downwardly therethrough. A conical body member is provided, having in its upper end wall an insertion hole in which the plug is mounted. A support panel is provided at the bottom of the body and cone collars are attached on the outer surface of the body member, with vertical spacing between them. The traffic collar cone is made of flexible material and designed to recover its original shape after being impacted, so that injury to collar cone is eliminated or minimized.

U.S. Pat. No. 5,993,105 to Chan describes a safety marker that includes a hollow frusto-conical body and a base having a bowl-shaped main portion and a resiliently flexible skirt for yieldably stabilizing the marker against tipping relative to a supportive surface.

So far the solutions have focused on self righting of the traffic cone. However, these solutions are still not satisfactory from a safety standpoint since they still are either too rigid or can still relatively easy fall over. Accordingly, there is a need to develop a better traffic cone or marker device that further improves road and traffic safety.

SUMMARY OF THE INVENTION

The present invention provides a new marker device for increased safety due to a flexible design. The marker device of the present invention includes a base and a flexible means that is positioned over the base. The bottom part of the flexible means is attached to the base. The flexible means is, for instance, but not limited to, a coil and maintains in an original position in absence of a natural or traffic perturbation. However, flexible means deviates from this original position in presence of a natural or traffic perturbation. Moreover, the flexible means restores from this deviated position back to the original position after the perturbation disappears or is removed. Furthermore, the marker device of the present invention includes a cover to cover the flexible means. In addition, the present invention includes a light source to illuminate the marker device. The light source could be placed inside the cover and attached to the cover, flexible means or the base.

In view of that which is stated above, it is the objective of the present invention to provide a flexible marker device or cone to improve safety.

It is still another objective of the present invention to provide a marker device with a flexible means that positions itself to an original position.

It is still another objective of the present invention to provide a marker device with a flexible means that deviates from its original position to a new position and wherein the deviation is dependent on the type of perturbation.

It is still another objective of the present invention to provide a marker device with a flexible means that restores from the deviated position back to its original position, whereby the restoring mechanism in an inherent property of the flexible means.

It is yet another objective of the present invention to provide a marker device with a base that is less likely to fall over as a result of a perturbation.

It is yet another objective of the present invention to provide a marker device with a light source to illuminate the marker device.

The advantage of the present invention over previous devices is that the present marker device can more easily resist various types of perturbations without falling over. Yet another advantage is that the marker device of the present invention significantly reduces the damage to persons or vehicles. These advantages are accomplished by a marker device with a base that remains on the ground and a flexible part that deviates from its original position due to a perturbation in any direction and in any type of way irrespective of the type of perturbation.

BRIEF DESCRIPTION OF THE FIGURES

The objectives and advantages of the present invention will be understood by reading the following detailed description in conjunction with the drawings, in which.

DETAILED DESCRIPTION OF THE INVENTION

Although the following detailed description contains many specifics for the purposes of illustration, anyone of ordinary skill in the art will readily appreciate that many variations and alterations to the following exemplary details are within the scope of the invention. Accordingly, the following preferred embodiment of the invention is set forth without any loss of generality to, and without imposing limitations upon, the claimed invention.

The marker device of the present invention could be used to alert or divert vehicles, watercrafts, aircrafts and pedestrians to pass safely around hazards, obstacles or other areas. However, the marker device of the present invention is not limited to any particular use and could also be used for sporting events. Furthermore, the marker device is usually recognized as a cone and is therefore called safety cone. However, the marker device of the present invention is not limited to any particular shape and could also be straight, curved, circular, cylindrical, square or any type of shape that is needed or required to alert or divert someone. Therefore, the device of the present invention is referred to as a marker device. Furthermore, there is also no restriction to the size of the particular marker device or safety cone of the present invention.

Figure 1:
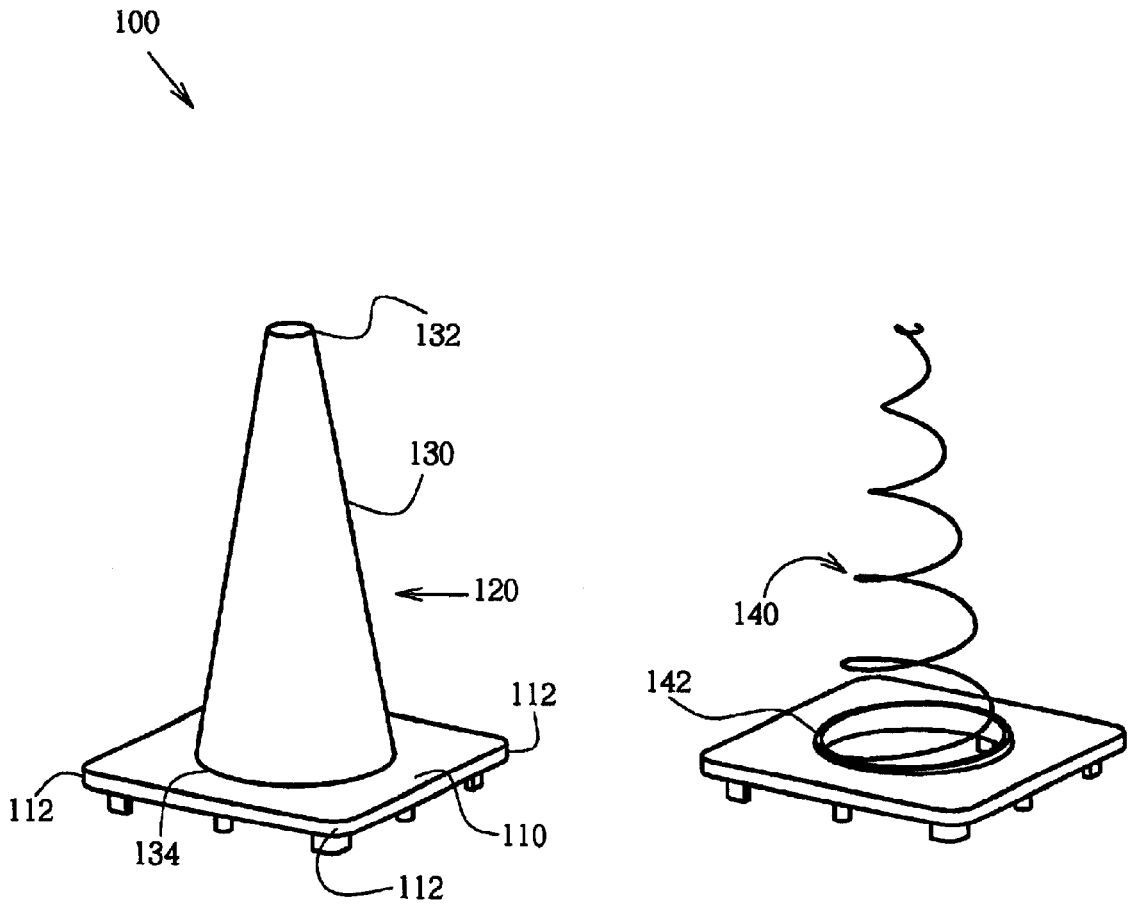
FIG. 1 shows an exemplary embodiment of a marker device according to the present invention.

FIG. 1 shows an exemplary embodiment of the marker device 100 according to the present invention. Marker device 100 includes a base 110 and a cone 120. Base 100 provides the support of marker device 100 and keeps the marker device on the ground or surface. Base 110 is shown as a square with round edges 112. However, base 110 could take any type of shape and could also be de out of any material as long as it provides the required support. The measurement (length and width) of base 110 is preferably, but not limited to, about 14" by 14", which is the standard base size for conventional safety cones. Cone 120 includes a flexible cover 130 that covers a flexible means 140. Preferably, cover 130 is made out of a flexible material that allows cone 120 to easily flex, bend or fold. Cover 130 should not, or at most minimally, resist the movement of flexible means 140 as a result of the perturbation(s). The top 132 and bottom 134 of cover 130 could be attached to flexible means 140. Instead of attaching bottom 134 of cover 130 to flexible means 140, bottom 134 could be attached to base 110. The type of means for connecting cover 130 is, for instance, but not limited to, stitches, clamp(s), glue, velcro or the like. However, cover 130 could also fit tight over flexible means 140 and in this case there is no need for a connecting means to connect cover 130.

FIG. 1 shows cone 120 in a cone shape. However, as discussed above, cone 120 could take any type of shape and the shape is mostly dependent on the type of marked device. Cone 120 could, for instance, be shaped as an inverted cone, a cylindrical marker, a circular marker, a square marker, a hexagonal, a tubular marker or any three-dimensional shape type marker.

Figure 2:
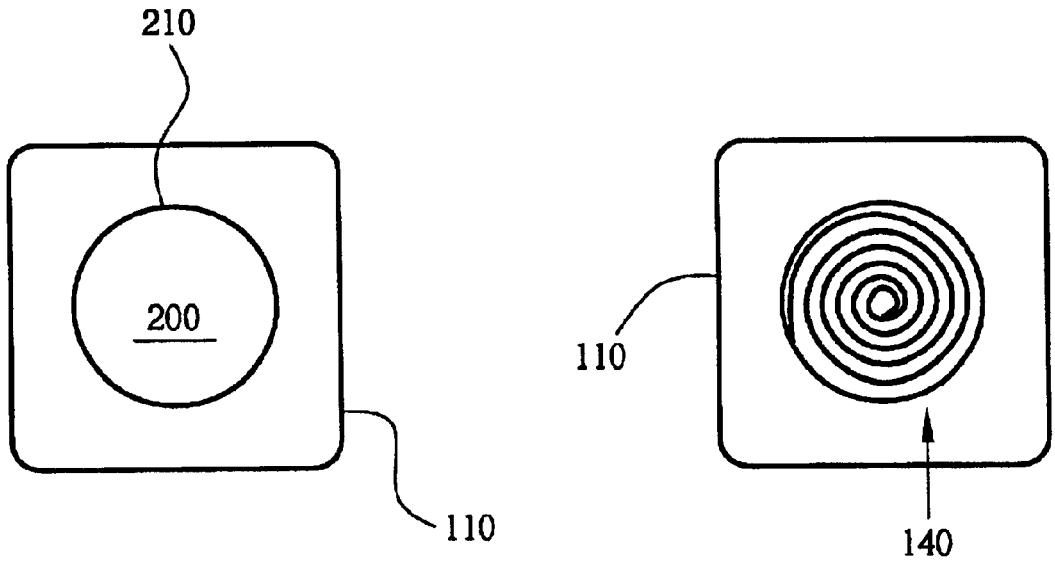
FIG. 2 shows a top view of a marker device according to the present invention.

FIG. 2 shows a top view of base 110. In some embodiments, base 110 provides a circular opening 200, however, such an opening is not necessary. Opening 200 is, however, preferred so that the marker devices of the present invention can be stacked as is common in the prior art. FIG. 2 also shows a top view of flexible means 140 without cover. The bottom part 142 of flexible means 140 is attached to base 110, preferably centered over base 110. In case base 110 has opening 200, flexible means 140 is attached close to the edge 210 of opening 200, either at the inside of opening 200 or at the top of base 110.

Figure 3:
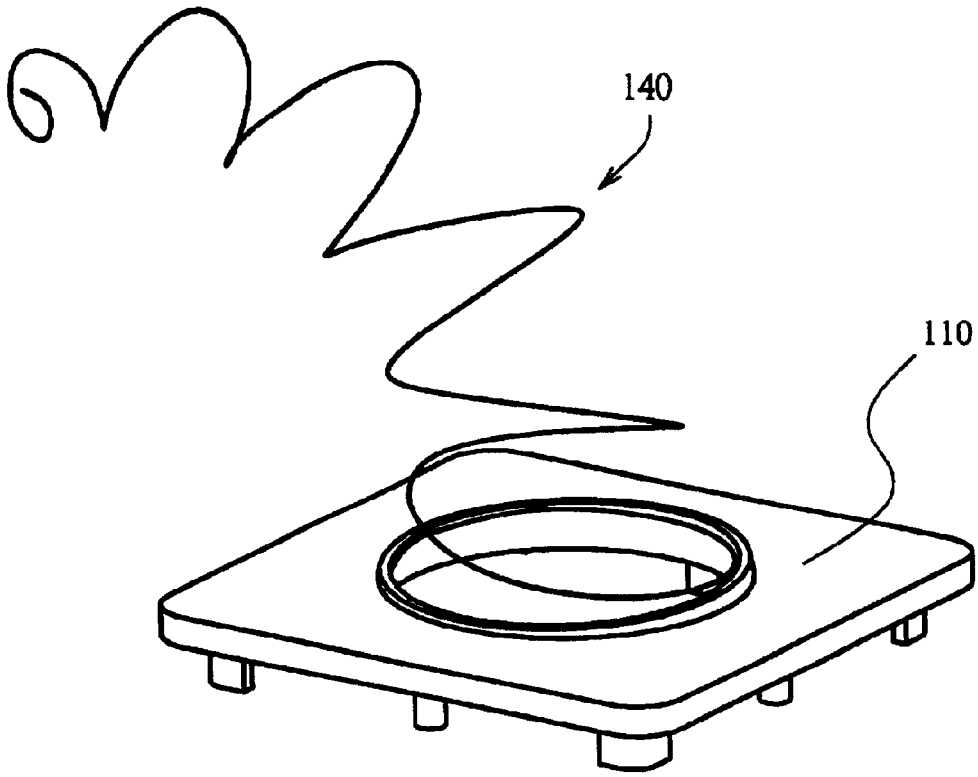
FIGS. 3–4 show exemplary embodiments of the flexibility of a marker device according to the present invention.
Figure 4:
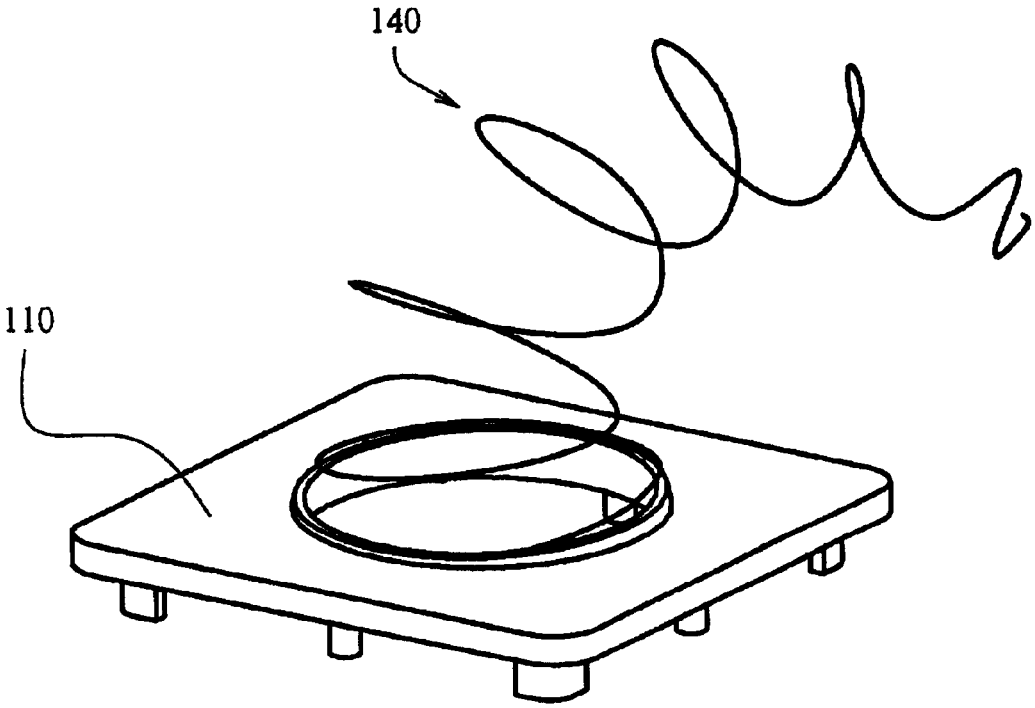

Flexible means 140 is, for instance, a coil that is shaped as a cone when marker device 100 is meant to be safety cone. Flexible means 140 provides for the flexibility of marker device 100. The key idea of the present invention is that the base remains on the ground or surface, and the flexible means is in either its original position or a deviated position from the original position. Flexible means 140 flexes, bends or folds to any direction as shown in FIGS. 3–4 and could, for instance, bend sideways, downward or even flex/extend upward. In other words, flexible means deviates from its original position (i.e. natural or neutral position in case flexible means is a coil or a spring). The direction and amount of deviation from the original position depends on the type of perturbation force (i.e. the amount and direction of the perturbation force at the marker device). Once the perturbation is removed or disappears, flexible means restores from the deviated position to its original position. The present invention is not limited to an indirect or direct contact perturbation. Examples of different types of perturbations are, for instance, but not limited to, natural wind (indirect), traffic wind (indirect), perturbations from passing traffic (indirect and/or direct) or even violence (indirect and/or direct).

Figure 5:
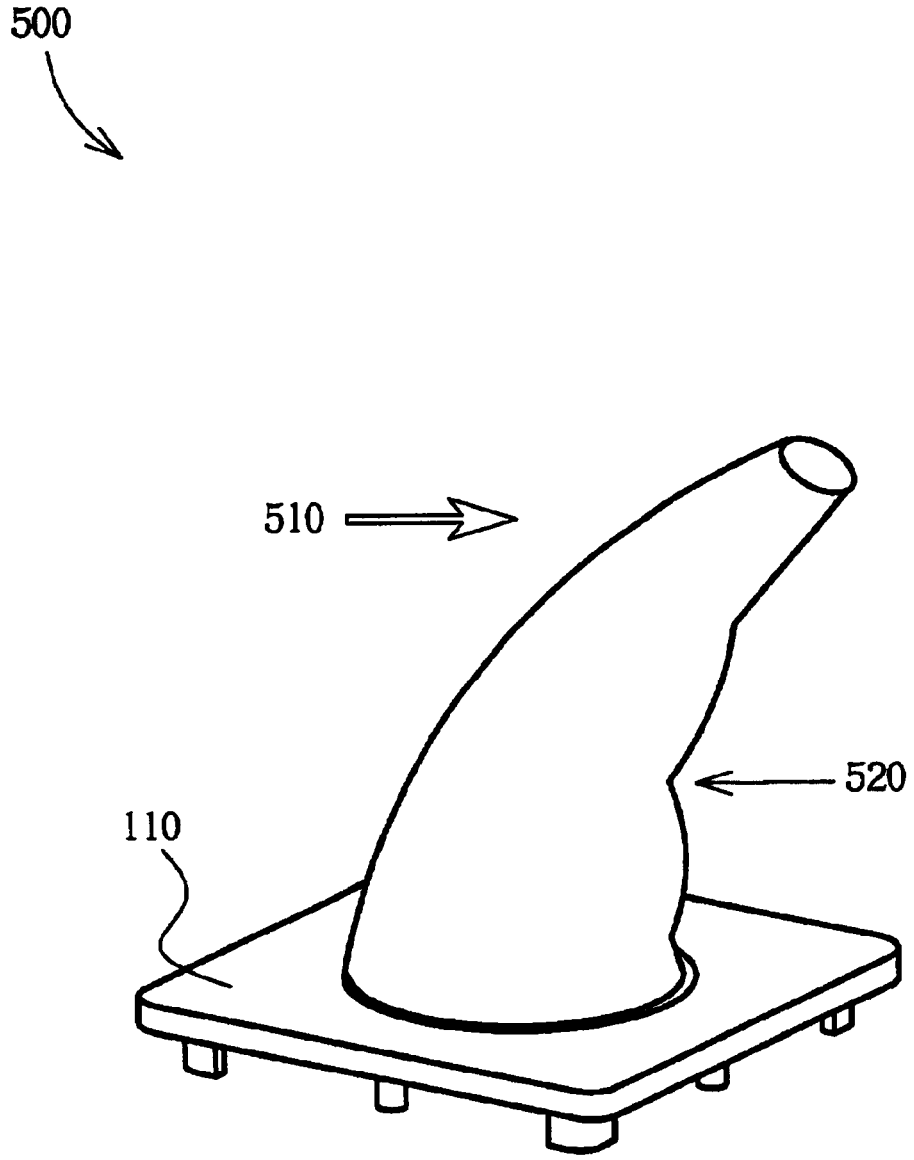
FIG. 5 shows an example of a position of a marker device due to a perturbation according to the present invention.
Figure 6:
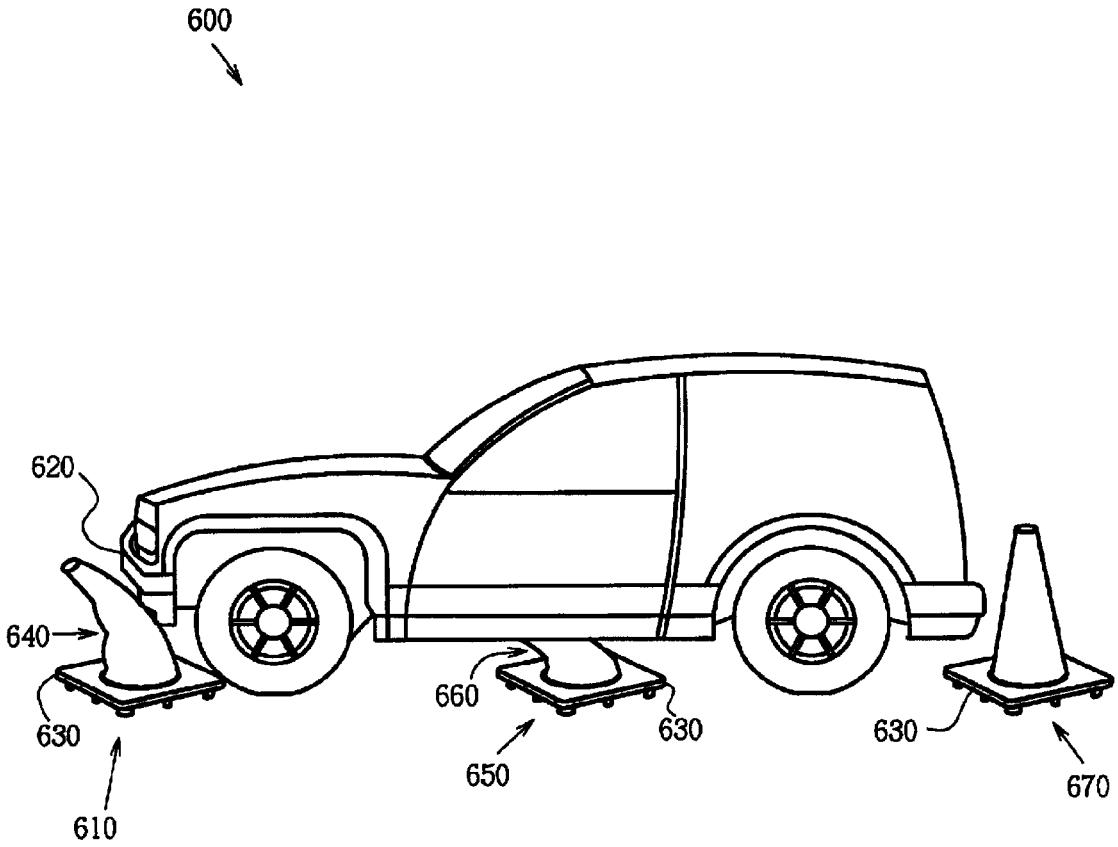
FIG. 6 shows an example of a marker device when a marker device is hit or run over by a car according to the present invention.

FIG. 5 shows marker device 500 subject to a perturbation force 510 that makes flexible means (not visible in FIG. 5 since it is covered by the cover) flex, bend or fold away from its original (upright) position as it is shown in FIG. 1. Consequently and due to the flexible material of the cone, cone 520 flexes, folds or bends according to the new position of flexible means as a result perturbation 510. FIG. 6 shows a situation where a car 600 runs into and over a marker device of the present invention, i.e. direct perturbation force. When car 600 hits marker device 610 with bumper 620, base 630 remains on the ground and only the flexible means and cover bend as indicated by 640. In the example of 640, the impact between the car and flexible means causes the original position of the flexible means (see e.g. FIG. 1) to change to a deviated position 640. To sustain such a deviation, the flexible means has an impulse response to the direct perturbation force as shown in FIG. 6, When marker device 650 is under the car, base 630 again remains on the ground and only the flexible means and cover bend as indicated by 660. The bent position is characterized by having part of the flexible means bent up to a substantially horizontal position with respect to the base. The marker device re-positions itself to the original (upright) position when the car is no longer on top of the marker device as indicated by 670. Another example (not shown) is that the marker device of the present invention could be dropped down to the ground (which results in an indirect perturbation to the flexible means), for instance, but not limited to, from a car or a truck that is delivering several marker devices to an area to, for instance, block an obstacle. After landing on the ground, the marker devices of the present invention might initially rock but will come to their original and stable position once the rocking motions oscillate out. The impact of the landing of the marker device on the ground also causes sudden perturbations to the flexible means. However, as discussed supra, these perturbations do not disturb the stability of the marker device due to the fact that the flexible means has the ability to deviate from one position to another in response to the perturbation force that acts on the flexible means (i.e. the flexible means has an impulse response to the perturbation force(s)). Similarly to the car perturbation, the bent position as a result of such an indirect perturbation is characterized by having part of the flexible means bent up to a substantially horizontal position with respect to the base. The likelihood that the marker device of the present invention remains in that position is also facilitated by the marker device of the present invention having a very low center of gravity (close to the ground or supporting surface). The low center of gravity is mainly due to a relatively heavier base compared to a combined weight of the flexible means and cover that over positioned over the base (flexible means and cover are preferably made of lightweight material(s)). The center of gravity of the marker device could virtually be close to the top of the base or somewhere in the base in case the difference between the weight of the base and combined weight of the flexible means and cover that are positioned over the base is large as a person of average skill would readily appreciate.

Important to note is that despite any type of perturbation, the base of the marker device has a high likelihood to remain on the ground or surface and it is only the flexible means and cover that deviates from the original position to a new position depending on the perturbation force. In addition, when the perturbation is removed, the flexible means and cover re-positions itself to its original position. However, it would be possible that as a result of a perturbation the base initially starts to rock, however, the rocking of the base will oscillate out and the base will come back to its original stable position on the ground or surface. In practice, safety cones or marker devices could also be glued to the ground or surface which makes the advantages of the present invention even more clear since the flexible cone (i.e. flexible means and cover) easily deviates from its original position in a safe manner and the base remains on the ground. The base could therefore include a securing means to temporarily secure the base to a surface or ground. Examples of securing means could be a glue, nails, screws, hooks or the like.

Figure 7:
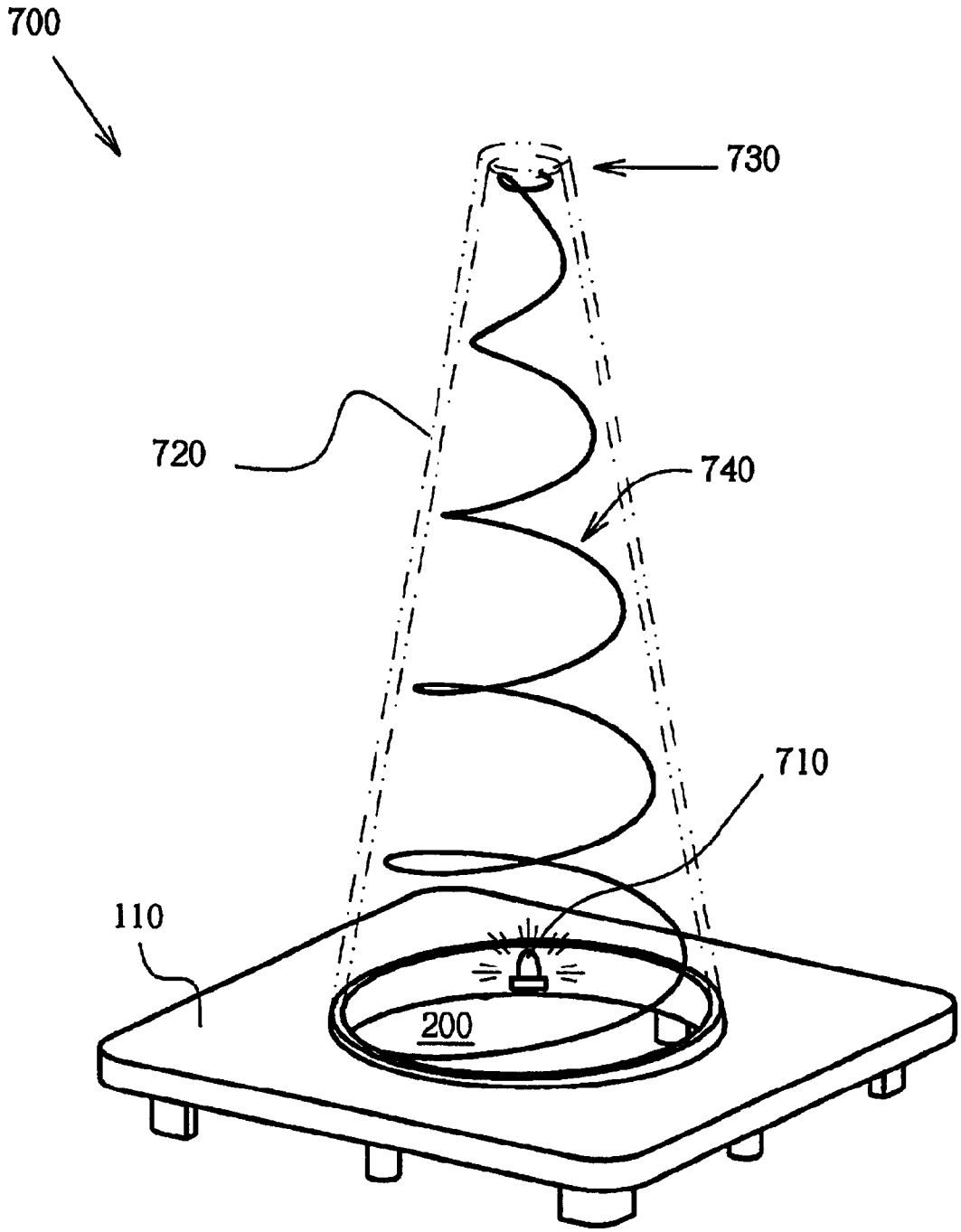
FIG. 7 shows a light source within a marker device according to the present invention.

Furthermore, the marker device of the present invention includes a light source 710 as shown in marker device 700 in FIG. 7. Light source 710 could be positioned anywhere inside cover 720 to illuminate the inside of cover 720. However, light source 710 could also be positioned to the base or flexible means. In case a light source is included, it would be preferred that the material of the cover is transparent to light so that the marker device becomes visible in the dark or in situations of poor visibility. Light source 710 could be any type of light source and is not limited to a particular type or mechanism. Light source 710 is preferably small and positioned by or near opening 200 of base 110. However, light source 710 could also be positioned near the top 730 of the flexible means 740. The marker device of the present invention could also have a sensor to turn on the light source. The sensor could, for instance, be positioned at the bottom of the base. Once the marker device is placed on the ground or surface, the sensor turns on the light source and the marker device becomes lit. The sensor could, for instance, be a mechanical switch. However, the sensor is not limited to a mechanical switch since it could also be a light-sensitive sensor that turns on the light source depending on whether it is, for instance, day-time or night-time. In addition, the sensitivity of the sensor can also be set so that it will be turned on when the visibility becomes less.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. For instance, flexible means could be any type of flexible material and is not limited to a coil as long as the material provides the necessary flexibility to meet the objectives and advantages of the present invention. Furthermore, the outside of the cover could include all kinds of shapes of reflective material (not shown). Preferred reflective shapes (reflective collar(s), stripes, or other types of regulatory shapes) are the ones recommended by the Government and include common traffic control or warning signs. Any other type of shape or sign can be included and is depended on the type of application. All such variations are considered to be within the scope and spirit of the present invention as defined by the following claims and their legal equivalents.

What is claimed is:

1. A safety marker device, comprising:

(a) a base having an opening for stacking with another safety marker device;

(b) a flexible means having an impulse response to indirect and direct perturbations caused by a moving vehicle or caused by being dropped from a vehicle, said flexible means is positioned over said base, wherein said base supports said flexible means; and (c) a cover to cover said flexible means, wherein said cover is made of a flexible material and allows said impulse response to said indirect and direct perturbations;

wherein said base being heavier than the combined weight of said flexible means and said cover, wherein said flexible means maintains in an original position in absence of said indirect and direct perturbations, and flexes from said original position to a bent position in presence of any of said indirect and direct perturbations, wherein said bent position is characterized by having part of said flexible means bent up to a substantially horizontal position with respect to said base, and wherein said safety marker device has a low center of gravity mainly due to said heavier base, whereby said low center of gravity facilitates in restoring said original position and whereby said heavier base facilitates said flexing.

2. The device as set forth in claim 1, wherein said flexible means is a coil and said coil is shaped as a cone.

3. The device as set forth in claim 1, wherein said base is square.

4. The device as set forth in claim 1, wherein said base further comprises securing means to temporarily secure said base to a surface.

5. The device as set forth in claim 1, further comprising a light source.

6. The device as set forth in claim 5, wherein said light source is attached to said base.

7. The device as set forth in claim 1, wherein said cover comprises a reflective material.

8. A safety cone, comprising:

(a) a base having opening for stacking with another safety cone;

(b) a coil having an impulse response to indirect and direct perturbations caused by a moving vehicle or caused by being dropped from a vehicle, said coil has a cone shape and is positioned over said base, wherein said base supports said coil; and (c) a cover to cover said coil, wherein said cover is made of a flexible material and allows said impulse response to said indirect and direct perturbations;

wherein said base being heavier than the combined weight of said coil and said cover, wherein said coil maintains in an original position in absence of said indirect and direct perturbations, and flexes from said original position ton a bent position in presence of any of said indirect and direct perturbations, wherein said bent position is characterized by having part of said coil bent up to a substantially horizontal position with respect to said base, and wherein said safety cone has a low center of gravity mainly due to said heavier base, whereby said low center of gravity facilitates in restoring said original position and whereby said heavier base facilitates said flexing.

9. The safety cone as set forth in claim 8, wherein said base is square.

10. The safety cone as set forth in claim 8, wherein said base further comprises securing means to temporarily secure said base to a surface.

11. The safety cone as set forth in claim 8, further comprising a light source.

12. The safety cone as set forth in claim 11, wherein said light source is attached to said base.

13. The safety cone as set forth in claim 8, wherein said cover comprises a reflective material.

* * * * *

UNITED STATES PATENT AND TRADEMARK OFFICE

CERTIFICATE OF CORRECTION

PATENT NO. : 6,766,760 B2
DATED : July 27, 2004
INVENTOR(S) : Guadalupe C. Garcia It is certified that error appears in the above-identified patent and that said Letters Patent is hereby corrected as shown below:

Title page,
Item [56], References Cited, U.S. PATENT DOCUMENTS, "3,499,419" should read -- 3,132,624 --

Signed and Sealed this

Thirtieth Day of November, 2004

JON W. DUDAS
*Director of the United States Patent and Trademark Office*